US005274956A

United States Patent [19]

Figge et al.

[11] Patent Number: 5,274,956

[45] Date of Patent: Jan. 4, 1994

[54] DEVICE FOR GRINDING THE WORKING ROLLS OF A PLANETARY MILL

[75] Inventors: Dieter Figge; Peter Fink, both of Essen, Fed. Rep. of Germany

[73] Assignee: Mannesmann Aktiengesellschaft, Dusseldorf, Fed. Rep. of Germany

[21] Appl. No.: 810,033

[22] Filed: Dec. 19, 1991

[30] Foreign Application Priority Data

Dec. 21, 1990 [DE] Fed. Rep. of Germany ..... 4041989

[51] Int. Cl.[5] ..... B24B 5/37

[52] U.S. Cl. ..... 51/49; 51/215 CP; 51/215 UE; 198/346.2; 901/17

[58] Field of Search ..... 51/72; 901/14, 15, 16, 901/17; 414/225, 226; 198/346.2, 468.2

[56] References Cited

U.S. PATENT DOCUMENTS 3,028,020 4/1962 Peras ..... 198/346.2
5,035,086 7/1991 Katsuki et al. ..... 51/49
5,105,069 4/1992 Hakenewerth et al. ..... 901/16

FOREIGN PATENT DOCUMENTS 2622772 11/1977 Fed. Rep. of Germany ... 198/346.2
0446412 6/1975 U.S.S.R. ..... 901/17
0506496 5/1976 U.S.S.R. ..... 901/17

*Primary Examiner*—Robert A. Rose
*Attorney, Agent, or Firm*—Cohen, Pontani, Lieberman, Pavane

[57] ABSTRACT

A device for facilitating the grinding of the working rolls of a planetary rolling mill in which working rolls are mounted together with intermediate rolls in cages which rotate about a support body, a rolling mill having an upper planet roll and a lower planet roll. In order to provide a low cost and economically operating roll grinding device, allowing simple, fast and precise grinding of the working rolls with reduced mill down time, a planet roll (1) is associated with a manipulating device (2) which is moveable in at least three planes or axes of movement and with which the working rolls (3) can be removed individually from the planet roll (1) and fed to a grinding device (5) as well as returned into the planet roll (1).

4 Claims, 7 Drawing Sheets

DEVICE FOR GRINDING THE WORKING ROLLS OF A PLANETARY MILL

FIELD OF THE INVENTION

The present invention relates to a device for grinding the working rolls of a planetary rolling mill, in which two sets of working rolls are mounted together with intermediate rolls in cages, each set movable about a support body, forming upper and lower planetary rolls.

BACKGROUND OF THE INVENTION

German Patent Application DE 39 07 730 A1, incorporated herein by reference, describes a method and an apparatus for carrying out a method for grinding the working rolls of a planetary rolling mill, in which the entire set of rolls of the planetary mill is ground in with special grinding machine, without dismounting the working rolls.

There are generally a set of 24 working rolls associated with each of the planetary rolls, which must be reground after approximately every eight hours of use, because their surfaces become worn. Therefore, it may be appreciated that DE 36 07 730 A1 provides a considerable advantage and improvement over an earlier method for grinding the working rolls, consisting of removing the working rolls from the set of planetary rolls individually by hand, in the workshop or mill, and installing new ones. Particularly in the case of large machines of, for instance, strip width of about 1300 mm, this method is cumbersome, time-consuming and very expensive. However, the solution proposed in DE 39 07 730 A1, even though it constitutes a substantial simplification and improvement, as well as saving time in the regrinding process as compared with the traditional methods, has various problems, which result from the fact that the alignment of the planet rolls in a turning device, intended for the machining of the working rolls while in the installed condition, is very difficult. The precision of the grinding of the working rolls depends directly on the alignment of the planet rolls, therefore any imprecision in alignment or any misalignment will result in imprecise grinding, and thus the planetary mill using these rolls will not operate with greatest effectiveness.

Another disadvantage of the known apparatus for the grinding of working rolls consists of the high investment expenses for the equipment necessary for changing the various rolls. In particular, in the prior art method, at least three sets of rolls are required, each set of rolls consisting of two planet rolls having the support bodies, intermediate rolls and working rolls. The three sets of rolls required are a first set for rolling in the mill, a second set which is in the shop for regrinding of the working rolls, and a spare third set.

OBJECTS OF THE INVENTION

It is therefore an object of the present invention to provide an economic roll grinding apparatus to keep the investment costs as low as possible and to simplify the precise grinding of the working rolls as much as possible, and require only a small amount of required mill shut-down time, while the working rolls are reground.

It is another object of the present invention to allow a planetary rolling mill to operate with two sets of planetary rolls, instead of the usual three sets.

It is another object of the present invention to provide a device for grinding the working rolls of a planetary rolling mill, having a pair of planet rolls in which working rolls are mounted in cages together with intermediate rolls around a support body to form a planet roll, comprising a manipulating device associated with a planet roll, which has at least three axes of freedom, which removes a first working roll from said planet roll, and installs a second working roll on said planet roll. The device further comprises a grinding device, which receives said first working roll from said manipulating device and supplies said second working roll to said manipulating device.

It is a further object of the present invention to provide a device wherein said pair of planet rolls each has an axis, both axes being parallel, said planet rolls being arranged to define a rolling line therebetween having a direction of rolling, an entrance side and an exit side in said direction of rolling, said manipulating device being located at one of said entrance side and said exit side of said planet rolls in said direction of rolling and being displaceable from a resting position which is outside said rolling line into a working position in which said manipulating device is capable of removing and installing a working roll, further comprising a roll change carriage for receiving said working rolls from said manipulating device.

Another object of the present invention provides a device wherein said manipulating device is displacable along a vertical axis and located on an exit side in said direction of rolling of said planet rolls, said resting position being a position in which said manipulating device is displaced in a lowered position, below said rolling line.

A still further object of the present invention provides a device comprising a roller table for supporting a workpiece at said rolling line, wherein said roll change carriage is displaceable along an axis parallel to said axes of said planet rolls, from a location at a side of said roller table and parallel to said planet rolls at a position proximate to said manipulating device to a position outside said rolling line.

It is another object of the present invention to provide a device comprising a roller table for supporting a workpiece at said rolling line, wherein said manipulating device is guided along a vertical axis of displacement by two columns, said columns being located proximate to said planet rolls and being arranged laterally outside said roller table with respect to an axis generally parallel to said axes of said planet rolls.

It is a further object of the present invention to provide a device wherein said planet rolls each has an axis of rotation, and comprising a rotational drive for rotating said planet rolls about their axes, wherein said planet rolls are adapted to be displaced from said rolling line along said axes of rotation, further comprising a pair of manipulating devices arranged in radially opposite positions about said planet rolls, and when said planet rolls are in said axially displaced positions, said manipulating devices cooperating with receivers for said receiving said working rolls after removal and before installation thereof, said receivers being arranged radially lateral and parallel to said manipulators with respect to said planet rolls.

It is a still further object of the present invention to provide a device comprising a roll stand in which each of said planet rolls has an axis, said planet rolls lying vertically spaced with said axes horizontal and parallel to one another, said planet rolls being adapted to be simultaneously displaced axially out of said roll stand, a transport device for axially displacing said planet rolls, a crane for individually transporting said planet rolls to a turning device having an axis of rotation, said turning device being independent of said roll stand, and having clamping means for clamping said planet roll in a plurality of positions of rotation corresponding to a number and orientation of working rolls on said planet rolls, and wherein said manipulating device is spaced from said axis of rotation in a radial direction from said turning device, and being for removing a first working roll from said planet roll and installing a second working roll on said planet roll. Said manipulating device comprises a grabbing device comprising a pair of semicircular articulated snare arms and an actuator for opening and closing said arms, for automatically lifting said first working roll from said planet roll, installing said second working roll in said planet roll, and transporting said first working roll from a planet roll in said turning device to a storage apparatus and transporting said second working roll from a storage apparatus to a planet roll in said turning device. Said storage apparatus comprises a pallet adapted to be transported by an transport device to and from a rack storage device.

SUMMARY OF THE INVENTION

A preferred embodiment of the present invention has, associated with each planet roll, a manipulating device which is movable in at least three planes or axes of movement, also known as degrees of freedom, with which the working rolls can be individually removed from the planet rolls, fed to a grinding device and then returned into the planet rolls. The present invention provides a method and apparatus for changing the working rolls within, or in the direct vicinity of, the planet roll stand itself, without necessity for total removal of the planet rolls from the roll stand. According to the present invention, a planet roll can be provided with new working rolls within a very short period of time, and the process for changing the rolls requires equipment having a relatively low investment cost.

The method of the present invention preferably proceeds as follows: During a pause in rolling, one planet roll of a pair, and during another pause in the rolling, the other planet roll is provided with new working rolls. With a life of a working roll being approximately eight hours, the working roll set of a planet roll can be thus changed every four hours. In other words, within a four hour span, the working rolls of one of the roll sets may be changed, while during the subsequent four hour span, the working rolls of the other planet roll can be changed. The replacement operation can be automated by known means. Of course, it should be realized that the working rolls of one set need not be changed sequentially with the other set, and they may proceed simultaneously or in tandem, and a single roll changing apparatus may switch between the two rolls at any point.

The present method may be controlled by an appropriately configured general purpose computer or an industrial robot controller, operating according to a predetermined program. This controller may be based purely on time, or may have sensors to determine the condition of the working rolls and the status of the operation, and thus adaptively regulate the regrinding process. Such devices are known in the art and need not be recited herein. The controller may operate independently, or be attached to a main mill control, which would provide the advantage of allowing synchronization of the operation of the roll changing apparatus with other aspects of the mill operation. It should also be noted that the roll is exchanged with a device that acts like a robot arm, and thus the control apparatus and method will be similar to those employed in industrial automation and robotics applications.

The device for changing the rolls, hereinafter referred to as the manipulating device, acts to release the working roll from the planet roll, lift it and transport it in such manner as to remain in the clearance space of the rolls, and to place the roll to be reground on a transport carriage. The manipulating device then lifts a newly ground roll preferably from the same carriage, positions it through a path which remains in the clearance space of the rolls, and sets it in the working roll mounting of the planet roll vacated by the previously removed worn roll. The planet roll must therefore be positioned generally in an orientation which allows access by the manipulating device, but need not be in exact orientation, as would be required by an asinstalled-grinding method. The manipulating device, which has at least three degrees of freedom, can compensate for a certain amount of misalignment of the planet roll from the optimum position. Therefore, any planet roll rotation or displacement devices employed need not act with ultra high precision.

The available axes of movement are the angle of an "elbow" of the manipulator having an angular axis of movement, and an extension of an actuator portion, at the angle of the "elbow". The manipulator also has a pincer or grabber device which comprises the actuator, which is controllable to open and close, in order to hold and release a working roll. In another embodiment of the present invention, the manipulating device also has an axis of movement along the height or elevation of the "arm" of the manipulator, thus being a vertical axis of movement. Of course it should be realized that the manipulator device could have further functions and axes of movement, as desired or required by the specific implementation. For example, if required in order to clear the rolls during operation, or to accurately place the rolls on a transport or grinding device during changing, the manipulating device would also have an axis of rotation or movement about a vertical or horizontal axis, or some other axis of movement.

In one embodiment of the present invention, with the planet rolls on the rolling line, i.e., the rolls positioned to function within the mill at the normal location of the sheet to be rolled, a manipulating device for the working rolls, is present alongside the planet roll in the direction of rolling, which is normal to the axis of the roll. The manipulating device can be displaced in such a manner so as to be brought out of a resting position, which is outside of the rolling line, i.e., no part of the manipulating device crosses the center plane of the rolling mill, and thus does not interfere with the normal operation of the mill, and into a working position on the rolling line. The manipulating device may also be brought into a position where it cooperates with a roll change carriage which bears the working rolls which have been removed and those that are to be installed. When the manipulating device is positioned on the rolling line, it may interfere with the operation of the mill, but at this location it has access to the rolls. Thus, only during pauses in the operation in the mill may the device operate and be positioned at the rolling line. In accordance with the present invention, rapid change of the worn working rolls for regrinding is possible with a low cost machine so that the normally present pauses in the operation of the rolling mill can be utilized, even though they may be short, rather than requiring extended pauses specifically for that purpose so that all of the working rolls may be replaced. Since the life of the intermediate rolls and of the rolling segments of the support member on which the intermediate rolls rest is generally longer than the life of the working rolls, the planet roll can remain in the roll stand longer, so that a spare set of two planet rolls is no longer required. In addition, there are other known means for extending the time between major servicing of the rolling segments, such as providing a plurality of rolling segments on each support member, and rotating at least a part of the support member to engage a new rolling segment. These methods are known in the art, and need not be described herein. In this way, one can get along with two sets of planetary rolls instead of the three required heretofore.

In accordance with another aspect of the present invention, the manipulating device is arranged to be displacable along an axis which is normal to the rolling plane of the planetary rolling mill defined by the pair of planetary rolls, i.e., displaceable along a vertical axis, and is thus raisable and lowerable, on the outlet side of the planetary mill, being positioned to be below the roller table plane when in the resting position. In this case, the manipulating device bears a so-called "looper roller" for adjusting the loop or snare device at an end portion thereof. In this way, a particularly simple and suitable construction results. With such a device, 24 worn working rolls can be replaced with newly ground working rolls within about 45 minutes by the manipulating device. In this case, the manipulating device cooperates with a roll change carriage which transports removed working rolls away and feeds new working rolls to the device.

In accordance with another aspect of the present invention, the manipulating device and roll change carriage are arranged directly behind, in the direction of the movement of the sheet in the mill, and alongside of the planet roll stand and the roll change carriage is transversely displaceable from a position at the side of the roller table to a position alongside the manipulating device, which can be moved from the resting position, below the roller table plane, into the working position, alongside the planet roll.

Another aspect of the present invention provides that the manipulator, which bears on its top the looper roller for the adjustment of the loop or snare device is guided in movement along the axis normal to the rolling plane, i.e., moveable along a vertical axis, in raisable and lowerable manner, on housing columns on both lateral sides of the roller table. The drive source for further rotating of the working rolls into the specific position, in which each may be manipulated by the manipulating device, can be derived from the main drive of the planetary mill stand, which then rotates with a creeping speed of rotation, which is about one tenth the speed of rotation of the cage drive. The drive is driven to, and stopped, in each case, at the required position of the cages. In the case of 24 working rolls, the working rolls must rotate 15°, so that the next working roll is in position to be replaced by the action of the manipulating device.

The apparatus of the present invention has another advantage, namely that individual defective working rolls can also be replaced rapidly and easily without removal of the entire planet roll, should a defect occur during the operation of the roll. This defect may be detected manually, or through the use of automated sensors, through known means. If the sensing is automated, then the replacement may also be automated and controlled by a controller, in known manner.

According to a second embodiment of the present invention, a planet roll is coupled with the rotary drive and is movable laterally from the roll stand. In such a case, two manipulating devices are preferably arranged at a position corresponding to the removed position of the planet roll, parallel to and on both sides of the planet roll. Each of the manipulating devices cooperates with receivers, arranged parallel to the manipulating devices and lateral with respect to the extended planet roll, for supporting and transporting the working rolls removed, and those to be installed in the planet roll. Through the use of this device and the corresponding method, the time required for changing the 24 work rolls can be reduced to less than half an hour, because when the planet roll is moved out of the roll stand, this arrangement permits the application of two manipulating devices, arranged on the two sides of the planet roll. In this connection, the drive of the planet roll can also be used for turning the roll. This is accomplished by bridging the relatively short path of displacement of the planet roll, which has been moved out of the mill, by articulated shafts with length compensation. These extensible couplings do not interfere with the normal operation of the mill. After the planet roll is moved out, the working rolls are accessible to both manipulating devices, arranged one on each side, so that, in each case, two working rolls in opposite positions can be changed simultaneously. After completion of the changing of the rolls, the planet roll is again pushed into the stand, and moved into working position, so that it is immediately ready for operation. The working rolls which have been removed, and those which are to be installed, are held in each case in receivers arranged parallel to the manipulators, and are taken up from and deposited there.

According to a third embodiment of the present invention, which is particularly suitable for large planetary mills, the two planet rolls which lie one above the other are adapted to be moved out simultaneously from the roll stand by means of a transport device. In such case, each roll is lifted, then deposited individually by crane in a rotating device, which is independent of the roll stand, and in which the planetary roll can be clamped in positions of rotation corresponding to the number and respective positions of the working rolls.

The manipulating device cooperates with the working roll lying opposite it in the planet roll on the rotating device. The manipulating device is preferably a grabbing arm or device, which may be a pair of semicircular articulated snare arms and an actuator for opening and closing said arms, by which means the working rolls can be automatically lifted out of the planet roll and a newly ground roll inserted into it, and can be transported to and from a storage location. The grabbing arm of the manipulating device removes the worn working rolls, one after another, out of the planet roll, and places them in a storage location. In accordance with another aspect of the present invention, this place may be one or more roll change carriages which are movable in synchronism back and forth between the manipulating device and the working roll grinding device. After placement of the working rolls, by the manipulating device, from the planet roll to the roll change carriage, the roll change carriage then moves with some or all of the worn working rolls to a grinding machine, where another grabbing device is possibly present, by which the working roll can be fed to the grinding machine.

Another aspect of the present invention is that the working rolls of the planet roll are easily removed and replaced. This can be achieved by a suitable known structural design and mounting of the working rolls, so that the manipulating means of the present invention may efficiently remove and install the working rolls.

BRIEF DESCRIPTION OF THE DRAWINGS

Embodiments of the invention are shown in the figures in the drawings, and will be described further below, in which.

DETAILED DESCRIPTION OF THE PREFERRED EMBODIMENTS

Figure 1:
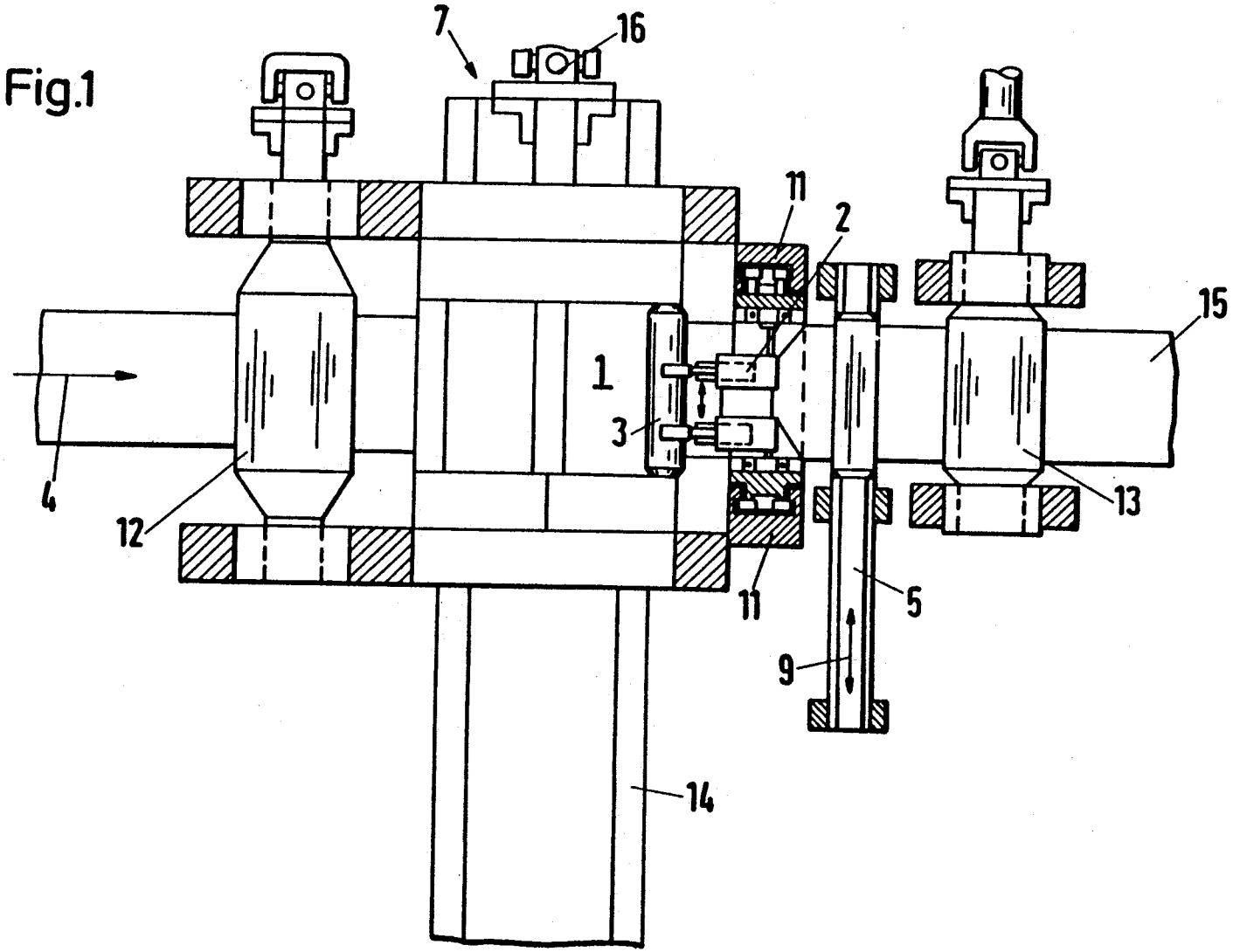
FIG. 1 is a top view of a planetary mill of the present invention, followed by a four-high stand.

FIG. 1 shows a planetary mill of the present invention in top view, greatly simplified. The planet roll 1 is mounted for being rotationally driven at 15 in the roll stand 7. The manipulating device 2 of the present invention, acts to remove, grip and deposit the working rolls 3 on the roll change carriage 5, which is arranged between the planet roll 1 and a four-high roll 13.

The rolling stock 15, which is the sheet subject to rolling in the planetary rolling mill, first passes through a feed roll 12 in the direction of rolling 4, then through the roll set consisting of the two planet rolls 1 in the rolling plane, and thereupon through the four-high stand having the four-high rolls 13. During the rolling process, the manipulating device 2 remains in lowered position on columns 11 arranged below the rolling line or rolling plane, as shown in FIG. 2, so that it does not interfere with the rolling process.

Figure 2:
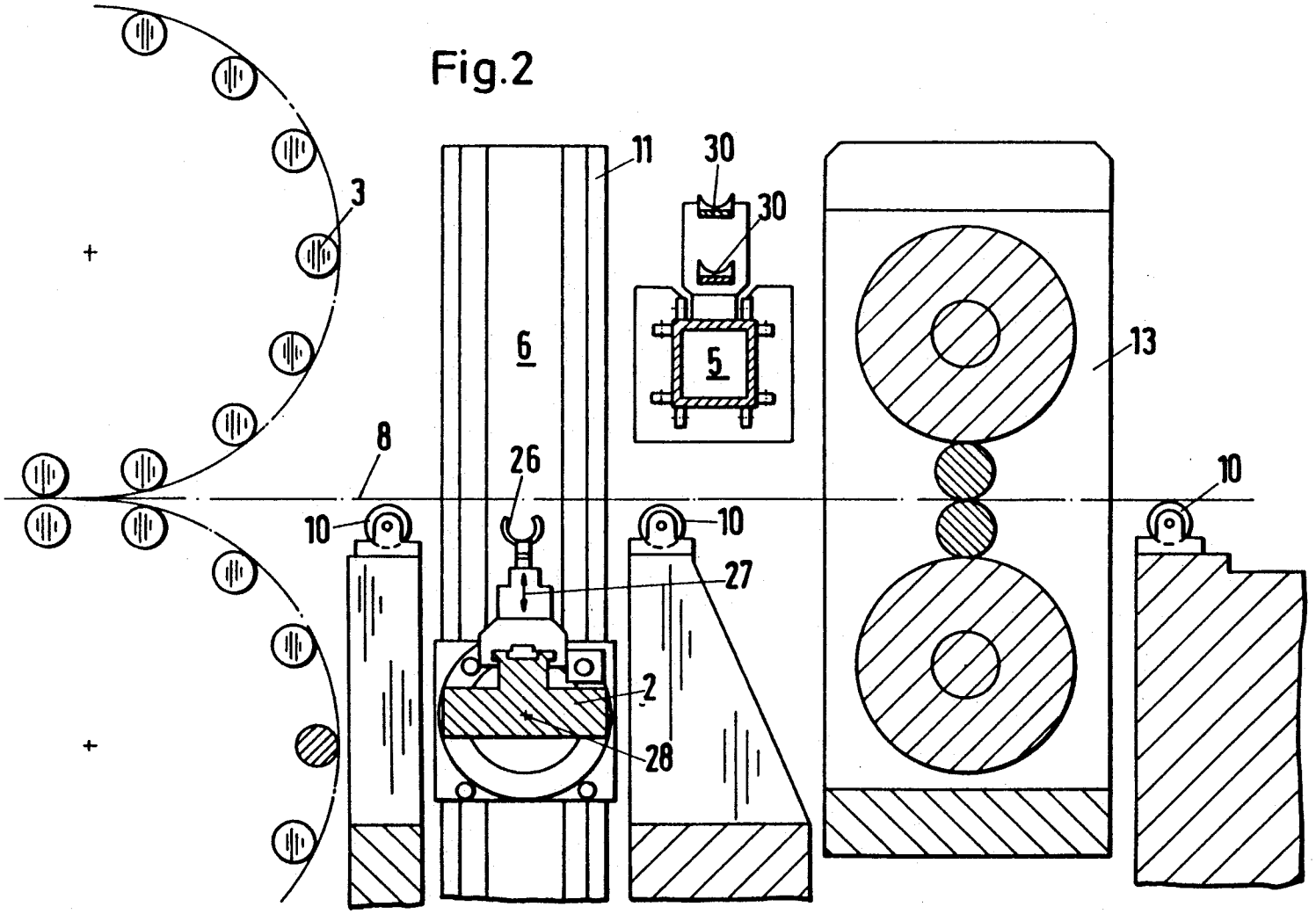
FIG. 2 is a side view of a manipulating device according to the present invention shown in a resting position during the rolling operation.

In FIG. 2 the same or corresponding parts bear the same numbers. It can be noted from the cross-sectional view that the manipulating device 2 can be raised and lowered on columns 11 arranged on both sides of the rolling stock 15.

The manipulating device 2 consists of a grabbing device 26 which can be moved in the direction of its grab opening, as indicated at 27, and, in addition, can be swung in both directions by, in each case, 90° around an axis of rotation 28 with respect to the position shown. Thus, the manipulating device 2 has at least two degrees of freedom in polar coordinates, r and $\phi$, an axis of movement in the height dimension on the columns 11 and has a further action being the actuation of the grabbing device 26. This manipulating device 2 is a "robot arm" which is controlled in known manner by a controller, not shown, and may be actuated hydraulically, electrically, by a hybrid technique, or actuated in other known manner. The control techniques for coordinating the movements of the manipulating device, as well as the other aspects of the operation of the elements of the present invention are also known.

The manipulating device 2 is positioned below the rolling line 8 so as not to interfere with the rolling process, when the mill is in operation. The rolling stock is supported on the roller table rollers 10, and guided between the planetary mill and the four-high stand. The roll change carriage 5, which will be described further below, is movable perpendicular to the plane of the drawing and in a resting position is located laterally above and alongside of the rolling stock 15. The roll change carriage 5 has two receivers 30 for holding two the working rolls 3, which are to be installed and removed.

Figure 3:
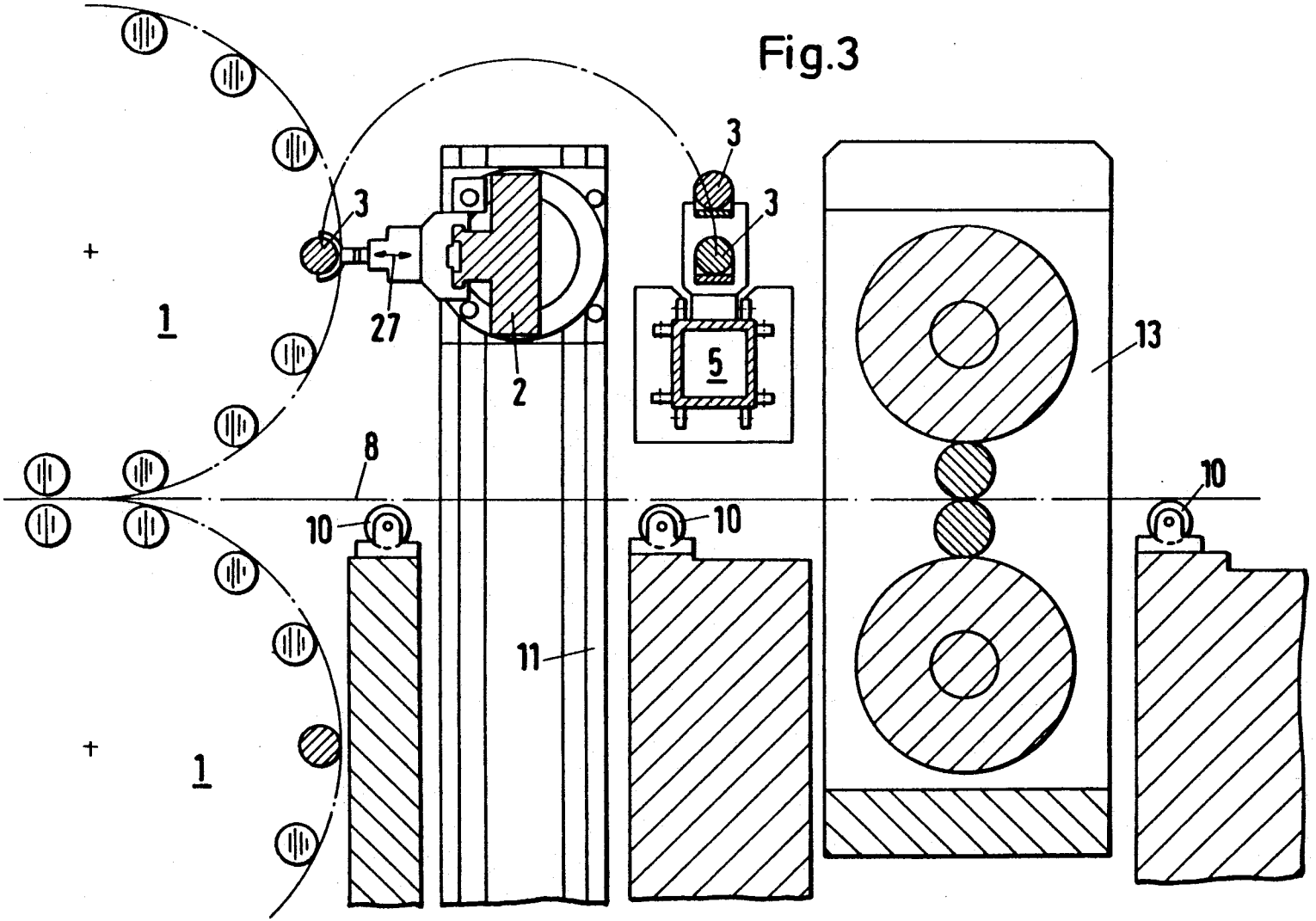
FIG. 3 is a side view of the manipulating device of FIG. 2 of the present invention, in a working position.

FIG. 3 shows the changing of the working rolls. In this process, the manipulating device 2 is moved upward on the columns 11 and the grabbing device 26 is swung 90° in the direction towards the planet roll 1, so that the grabbing device 26 is approximately aligned with a working roll 3. By movement of the grabbing device 26 radially outward from its axis of rotation, in the direction 27, the working roll 3 engages the grabbing device 26, and is then gripped by a closing action of the pincers to firmly hold the working roll and then, after the backward movement of the grabbing device 26, swung 180° so that the working roll 3 can be deposited in one of the receivers 30 of the roll change carriage 5. The pincers of the grabbing device 26 then release the worn working roll 3. A new working roll 3 is held in the other receiver 30 of the roll change carriage 5, which, in the same way, except in reverse order, is gripped, and after swinging of the manipulator 2 180° back toward the planet roll 1, is inserted into the plant roll 1, mounted and released. After further synchronous rotation of the planet roll 1 through an angle which corresponds to the distance between the working rolls 3, which, in the case of a planet roll having 24 evenly spaced working rolls 3 is 15°, the next and all further working rolls 3 are gripped and correspondingly changed one after the other. It should be noted that adjacent working rolls 3 need not be changed sequentially, but that this is the preferred method because it is efficient.

The process of changing the working rolls is repeated after lowering the manipulating device 2 below the rolling line 8 in front of the lower planet roll 1, so that all working rolls of the lower planet roll can also be replaced. Thus, a single manipulator device 2 may serve both the upper and lower planet rolls 1.

Figure 4:
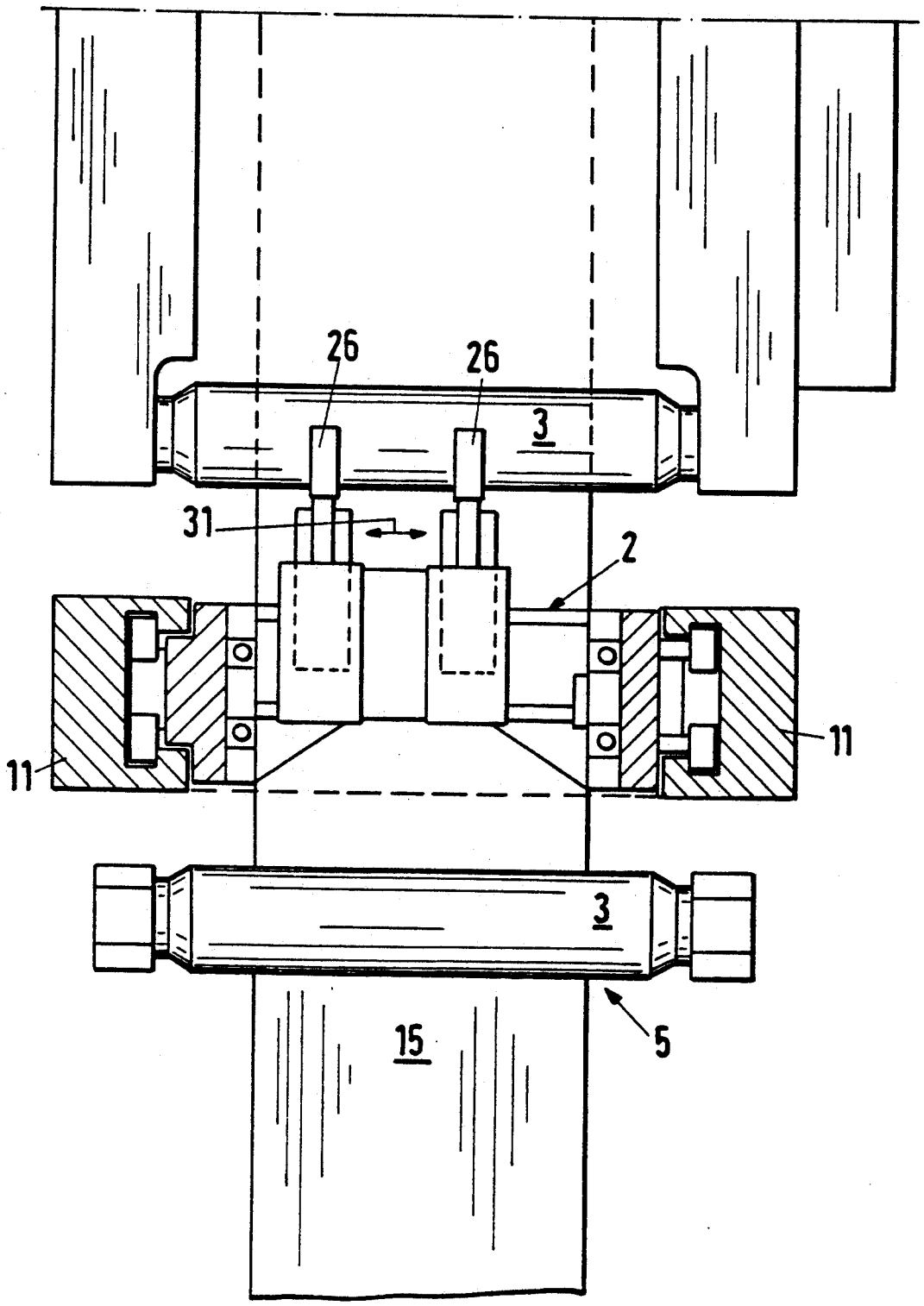
FIG. 4 is a top view of the manipulating device of FIGS. 2 and 3 of the present invention.

In FIG. 4 the device of the present invention is again shown, in top view. As indicated at 31, the grabbing device 26, which in this embodiment comprises a double grabbing device 26, having two pincers, each spaced transversely along an axis parallel to the axis of the working rolls, which can move transverse to the axis of the working roll so that the working roll can be moved laterally for removal from the planet roll. Otherwise identical parts are provided with the same reference numbers. It can be further noted in FIG. 4 that the roll change carriage 5 bridges over the rolling stock 15, and is provided on the side of the roller stand facing away from the planet roll 1.

Figure 5:
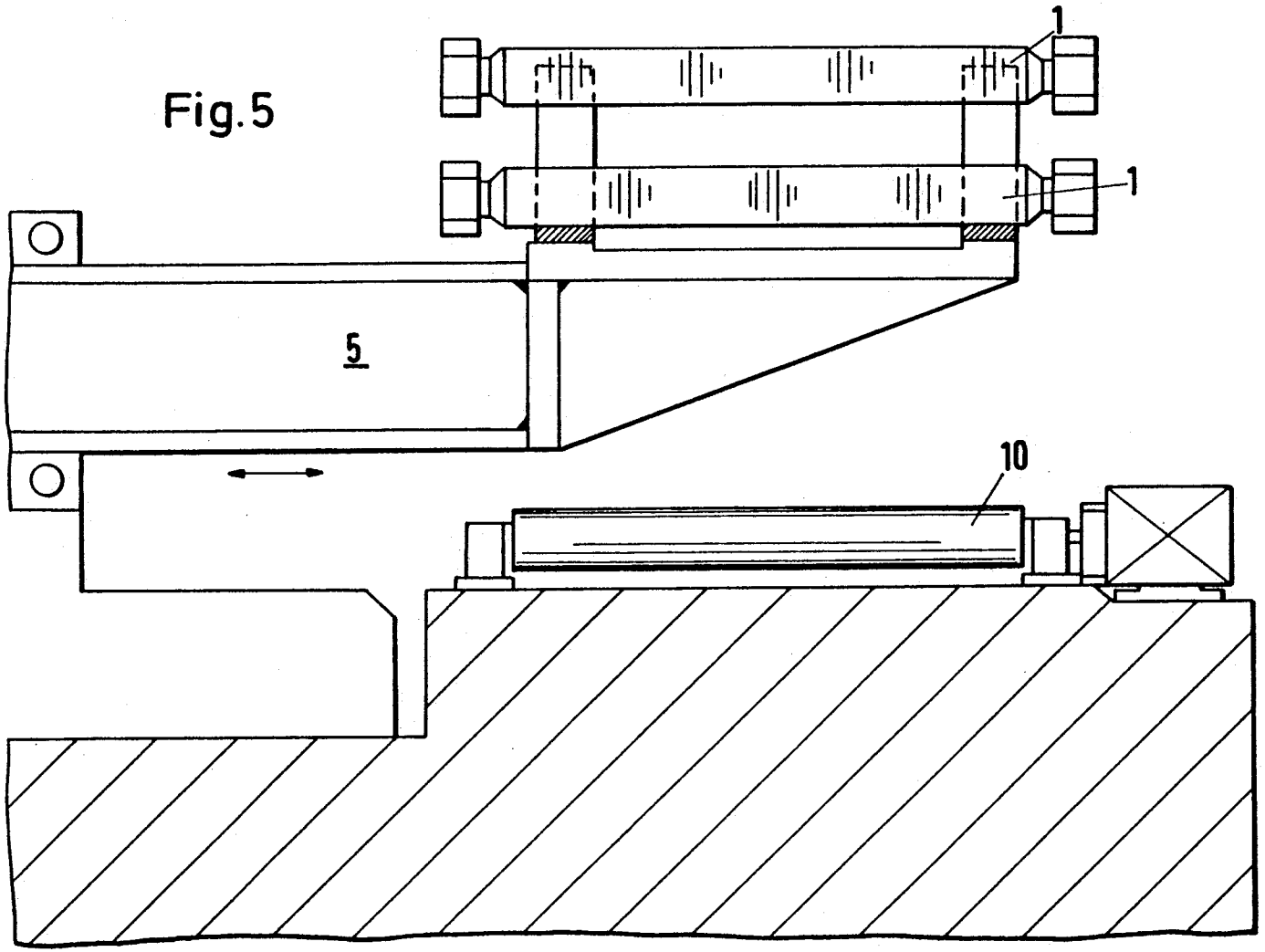
FIG. 5 shows the roll change carriage of the present invention, for receiving the removed working rolls.

As can be noted from FIG. 5, the roll change carriage 5 itself is displaceable transverse to the roller table 10, as shown by the arrow 32, so that during the rolling process it can be positioned laterally alongside the roller table 10. Furthermore, in its retracted position, the removal and insertion of the old and new working rolls 3 respectively is possible on the side of the roller table 10.

Figure 6:
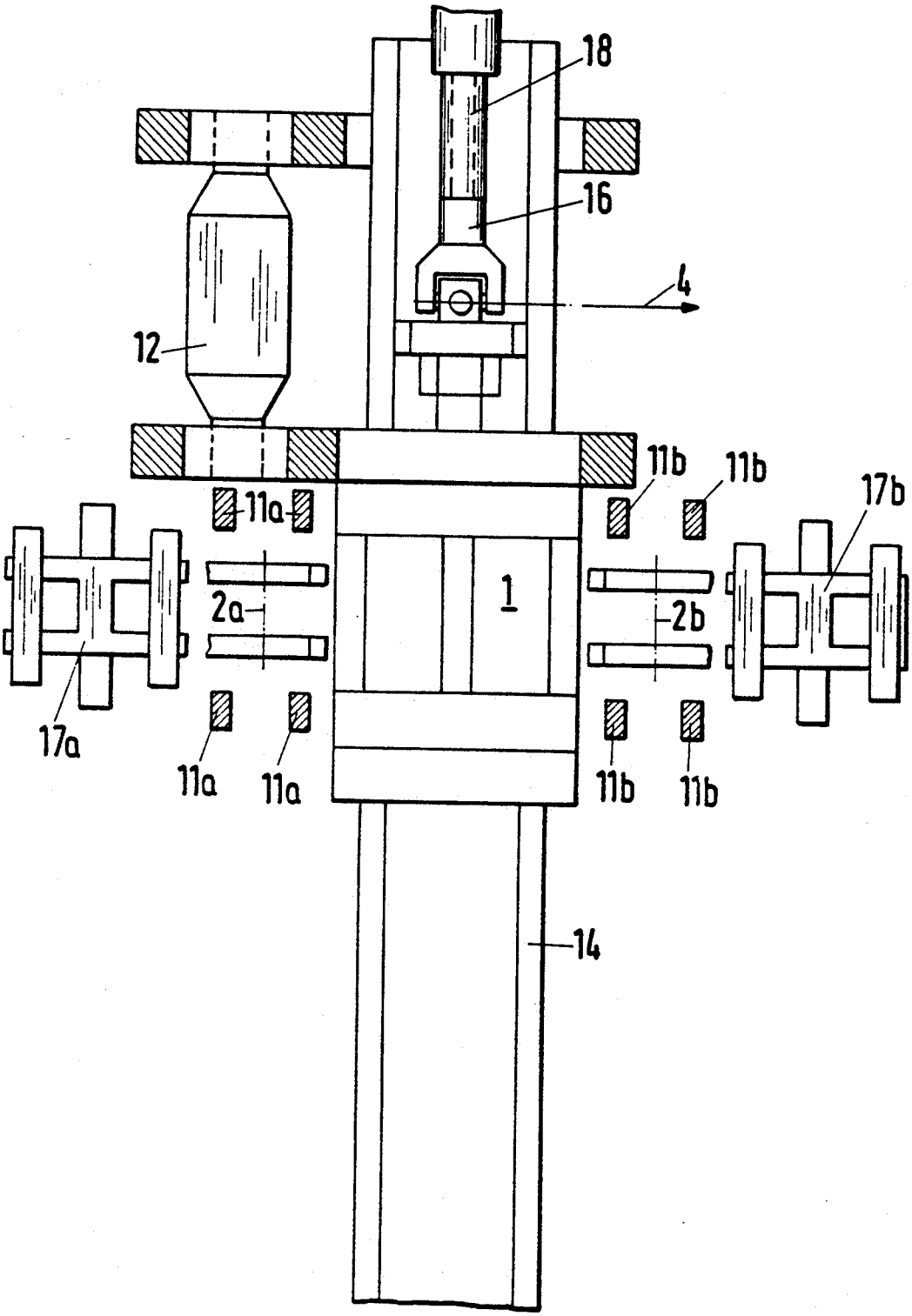
FIG. 6 shows in top view two other manipulating devices of the present invention.

FIG. 6 shows another embodiment of the manipulating device in accordance with the present invention, in which there are two manipulating devices. In this way, substantially shorter working-roll change times can be obtained since replacement can be effected simultaneously on both sides of the planet roll 1.

In FIG. 6, as in the earlier figures, 4 indicates the direction of rolling in which the rolling stock 15 passes through the feed rolls 12 and the planet rolls 1, when placed in working position, introduced in the roll stand. In FIG. 6, the set of planet rolls 1 is shown moved laterally in the direction 33, by the articulated shaft 18, out of the rolling line, with the drive 16 remaining connected with the planet rolls 1, so that they may be rotationally repositioned during working roll 3 replacement.

The drive 16 is provided with an articulated shaft 18 with axial equalization, i.e., the drive shaft can be telescopically extended, by known means. In the extended position of the planet rolls 1, shown in FIG. 6, the planet rolls 1 have, on both sides, indicated at 2*a* and 2*b*, manipulating devices which correspond to the manipulating devices 2 of the preceding FIGS. 1 to 5. Instead of the roll change carriage 5, receivers 17*a* and 17*b* are provided for the working rolls 3, in the form of round magazines in which the removed working rolls can be deposited and from which the new working rolls can be removed.

Guide rails 14 direct the movement and further support the set of planet rolls 1 as they are removed from the rolling line 8. The columns 11 on which the manipulating devices 2*a* and 2*b* are moveable in the same manner as described above, are arranged here outside the rolling line, on both sides of the planet roll 1. This arrangement permits a change of working rolls 3 in a manner similar to that described above with respect to FIGS. 1 to 5, with the exception that there is no need presented by the stated elements for the manipulating devices 2 to have any particular orientation with respect to the rolling line when the mill is in operation. However, the planet roll 1 must be displaced in order that the working rolls 3 be replaced. Of course, other elements, not shown, may limit the manipulating devices 2 during mill operation.

Figure 7:
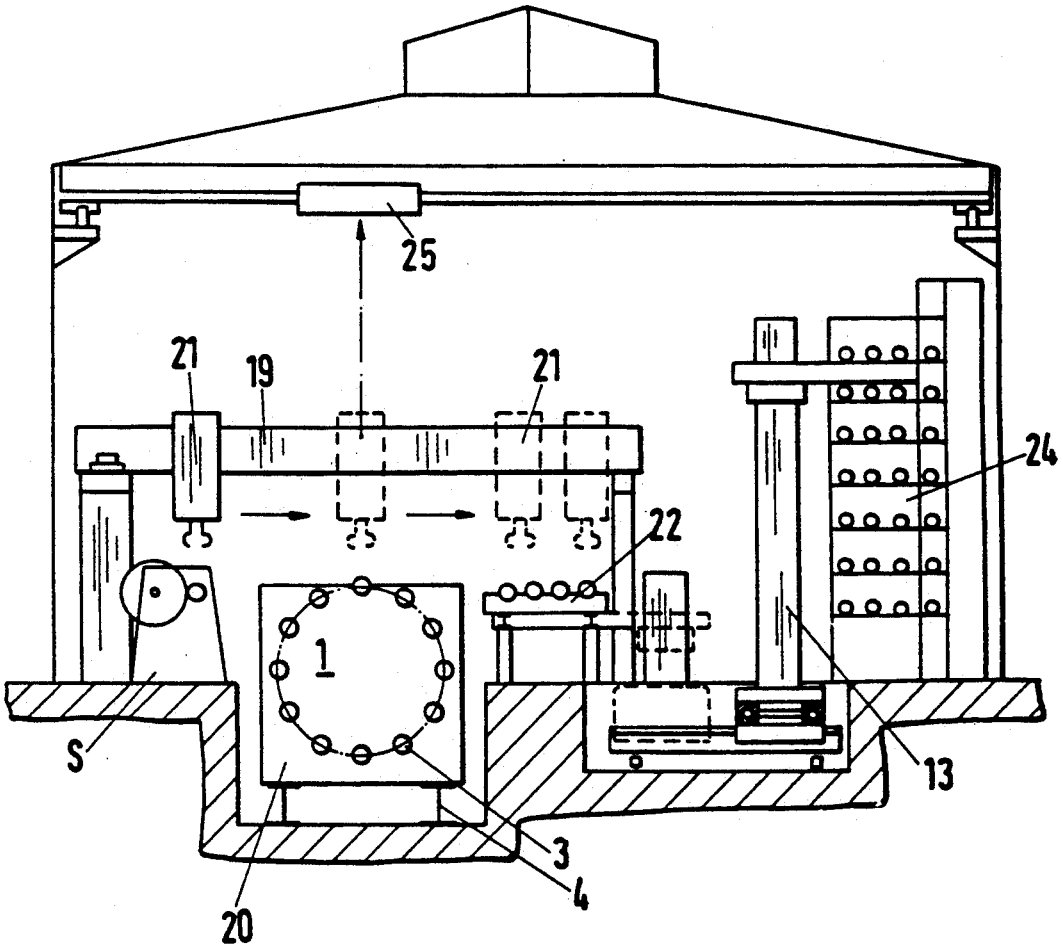
FIG. 7 is a cross section through a roll shop of the present invention.

FIG. 7 shows an example of a roll shop. The set of rolls which is removed, for instance, from the rolling mill on the guide rails 14, shown in FIG. 6, and is then detached from the drive 16. The planet roll 1 is taken individually, i.e., each planet roll 1 by itself, by a crane or the like, and placed in a turning device 20 for turning the planet roll 1 to a desired orientation, determined by the number and orientation of the working rolls. This turning device 20 is bridged over by a loading gantry 19, on which the manipulator device 21 is moveable horizontally for moving the working rolls 3 and further is extendable vertically in the direction of the working rolls. By means of the manipulator device 21, the working rolls which are on top are received and, after lateral displacement along the loading gantry 19, deposited on a pallet 22.

In an alternative embodiment, the manipulator device 21 can also transfer the working roll 3, which is has been lifted, directly to a grinding machine S for machining.

The pallet 22 is relocated by an operating device 13 and transferred to a rack storage unit 24, in which the working rolls 3 are stacked in pallets 22. The turning device 20 is provided with a step-by-step drive and a clamping device, which permits a stepwise turning of the planet roll 1, to the appropriate orientations. In this way, each working roll 3 can be handled individually, i.e., removed and installed. The various components may be controlled manually or automatically by means of a control, not shown in the drawings, which operates in known manner.

It should be understood that the preferred embodiments and examples described are for illustrative purposes only and are not to be construed as limiting the scope of the present invention which is properly delineated only in the appended claims.

What is claimed is:

1. A transfer device for transferring working rolls of a planetary rolling mill to a grinding device, the planetary rolling mill including a pair of planet rolls, each planet roll being formed by a plurality of working rolls mounted in cages together with intermediate rolls around a support body, each planet roll having an axis, the axes of the planet rolls extending parallel to each other, said planet rolls being arranged to define a rolling line therebetween having a direction of rolling, an entrance side and an exit side in said direction of rolling, the transfer device comprising a manipulating device associated with each planet roll, said manipulating device having at least three axes of freedom, said manipulating device being located at one of said entrance side and said exit side of said planet rolls in said direction of rolling and being displaceable from a resting position which is rolling line into a working position in said rolling line, wherein said manipulating device is configured for individually removing the working rolls from said planet roll and for reinstalling the working rolls in said planet roll, further comprising a roll change carriage for receiving the working rolls from said manipulating device and for supplying the working rolls to the grinding device.

2. The device according to claim 1, wherein said manipulating device is displacable along a vertical axis and located on an exit side in said direction of rolling of said planet rolls, said resting position being a position in which said manipulating device is displaced in a lowered position, below said rolling line.

3. The device according to claim 1, further comprising a roller table for supporting a workpiece at said rolling line, wherein said roll change carriage is displaceable along an axis parallel to said axes of said planet rolls, from a location at a side of said roller table and parallel to said planet rolls at a position proximate to said manipulating device to a position outside said rolling line.

4. The device according to claim 1, further comprising a roller table for supporting a workpiece at said rolling line, wherein said manipulating device is guided along a vertical axis of displacement by two columns, said columns being located proximate to said planet rolls and being arranged laterally outside roller table with respect to an axis generally parallel to said axes of said planet rolls.

* * * * *